United States Patent [19]

Mooney

[11] 3,952,471

[45] Apr. 27, 1976

[54] PRECAST WALL PANEL AND BUILDING ERECTED ON SITE THEREFROM

[76] Inventor: Edward L. Mooney, 468 Webster St., Manchester, Mass. 03101

[22] Filed: Aug. 5, 1974

[21] Appl. No.: 494,772

[52] U.S. Cl. ..... 52/602; 52/125; 52/491; 52/434; 52/284; 52/274; 52/745

[51] Int. Cl.[2] ..... E04B 5/04; E04B 1/00

[58] Field of Search ..... 52/602, 601, 491, 274, 52/284, 434, 125, 745

[56] References Cited

UNITED STATES PATENTS

| | | | |
|---|---|---|---|
| 2,184,464 | 12/1939 | Myers | 52/284 |
| 2,833,139 | 5/1958 | Bosshart | 52/434 |
| 3,216,156 | 11/1965 | Carew | 52/274 |
| 3,216,163 | 11/1965 | Carew | 52/274 |
| 3,245,185 | 4/1966 | Rowe | 52/601 |
| 3,372,519 | 3/1968 | Russell | 52/601 |
| 3,423,895 | 1/1969 | Hawkins | 52/491 |
| 3,555,763 | 1/1971 | Bloxom | 52/601 |

FOREIGN PATENTS OR APPLICATIONS

| | | | |
|---|---|---|---|
| 517,689 | 1953 | Belgium | 52/434 |

*Primary Examiner*—Ernest R. Purser
*Assistant Examiner*—Robert Farber
*Attorney, Agent, or Firm*—Pearson & Pearson

[57] ABSTRACT

A building is quickly erected on the site, by preparing a footing below ground level, erecting at spaced apart distances around the footing a plurality of vertical precast, combined foundation wall and side wall panels of U-cross section which have load bearing vertical side edge flanges and may include a parapet section and then welding infill panels containing windows and doors between the load bearing vertical, side edge, flanges of the panels. The vertical side flanges of the one piece foundation and side wall panels form reinforced colums and the space therebetween may be used as air ducts, pipe chases or the like.

14 Claims, 8 Drawing Figures

PRECAST WALL PANEL AND BUILDING ERECTED ON SITE THEREFROM

BACKGROUND OF THE INVENTION

Factory fabricated buildings intended to be erected, or assembled, on the building site are well known and include the modular type, the sectional type and the pre-fab panel type.

It has heretofore been proposed to provide conventional buildings with concrete wall panels of uniform cross section supported by vertical steel I-beams both supported on a conventional above ground foundation, as in U.S. Pat. No. 1,858,701 to Boettcher of May 17, 1932, both supported on a subground level footing, as in U.S. Pat. Nos. 3,216,156 and 3,216,163 to Carew of Nov. 9, 1965. However, the panels of these patents are not of U-cross section with load bearing side flanges and they are more like curtain walls hung from the steel structure.

It has also been proposed to provide wall panels of a waffle or grid-like pattern, with no integral reinforced load bearing columns, and resting on a ground level slab, as in U.S. Pat. 2,184,464 to Myers of Dec. 26, 1939, U.S. Pat. 2,497,887 to Hilpert of Feb. 21, 1950, or U.S. Pat. 2,811,850 to Clary of Nov. 5, 1967. None of the panels of these patents are of U-cross section, none include an integral foundation wall portion extending below ground level to a footing and all rely on rib and groove vertical joints for sealing the edges of adjacent panels.

In Belgian patent No. 517,689 to Van Wetter of Feb. 28, 1953, spaced, concrete channels, or arched beams, horizontally span a roof and are of inverted U-shaped cross section. Horizontal panels are supported on ledges in grooves in the channels but the channels serve only to resist tension forces. There are no vertical wall panels in this patent capable of resisting compressive forces, or being mounted endwise one on the other to any desired height.

SUMMARY OF THE INVENTION

In this invention the wall panels are pre-cast of reinforced conrete in U-cross section with a main body of pre-determined height, width and thickness and integral laterally projecting edge flanges forming the integral load bearing columns of increased thickness. Each such pre-cast slab includes an integral lower portion extending down to a below ground level footing so that it is a combined foundation wall and side wall at least one story in height but capable of being cast with an integral parapet or with integral second, third, or fourth stories if desired.

Unlike the prior art, the pre-cast load bearing U-shaped side wall slabs are not connected edge to edge by rib and groove connection, but instead are spaced apart around the footing with an infill panel filling each space between slabs. The joints are sealed by compressible rods of neoprene held in compressed condition by the welding of plates in the side edges of the infill panels and slabs. No steel framework is thus required in the plane of the side wall. The windows and doors are in the infill panels and the vertical space between the integral columns of the U-shaped slabs is used to contain pipes, wires, or to serve as air ducts.

DESCRIPTION OF THE PREFERRED EMBODIMENT

Figure 1:
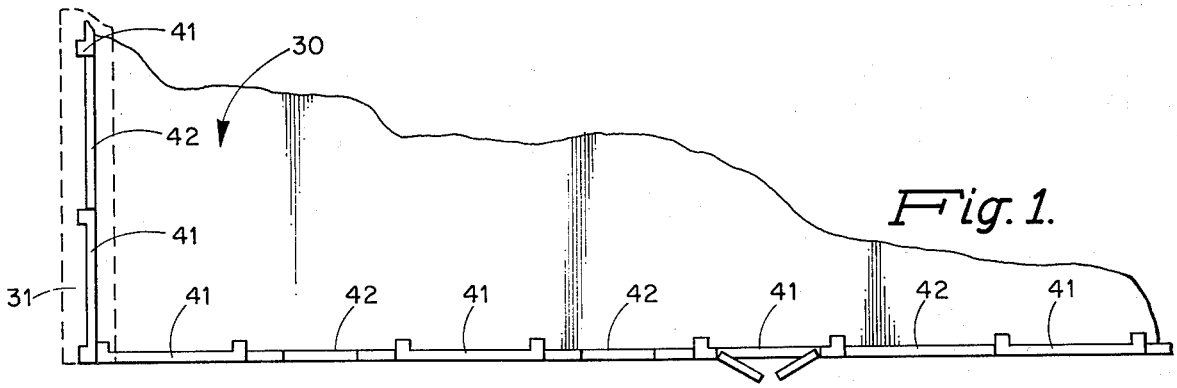
FIG. 1 is a fragmentary plan view of a pre-fabricated building constructed in accordance with the invention.

As shown in the drawings, the building 30 of the invention is of the pre-fabricated type to be erected at the site on a footing 31, at subground level 32, usually with a concrete floor slab 33 at ground level 34. The building 30 is at least one story in height, as at 35, with a ceiling 36 and roof 37 at roof level 38, but may be two, or more, stories in height as shown at 39 at the left of FIG. 1.

PRE-FABRICATED PANELS

The building 30 is constructed of a plurality of pre-cast, reinforced concrete, load bearing wall panels, or slabs, 41 used in combination with a plurality of infill wall panels, or slabs, of pre-cast reinforced concrete 42. The pre-fabricated panels 41 and 42 are of predetermined height, width and thickness and may be in varying lengths, for example up to 42 feet, while preferably being about 8 feet in width.

Figure 8:
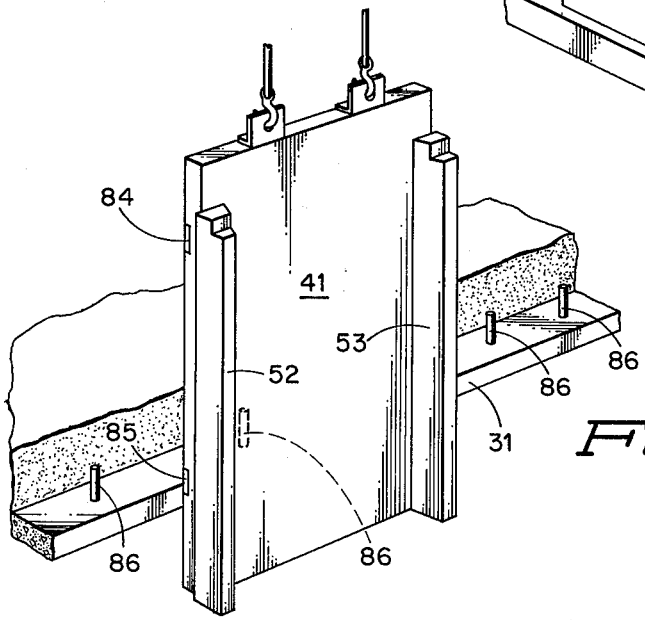
FIG. 8 is a perspective view showing a load bearing panel being hoisted into place on the footing.

Unlike the pre-cast wall panels of the prior art, which usually have been sectional vertically, and have been supported on a floor slab 33, the pre-fabricated panels 41 and 42 of this invention include an integral subground level portion 43 or 44, forming the foundation wall resting on the footing 31 and extend upwardly therefrom to the integral side wall portion 45 or 46 above ground level and at least one story in height to the next upper part of the building which is usually the ceiling 36 and roof 37. Each panel 41 and 42 may also include an integral parapet portion, such as 47 (FIG. 8), which extends above roof level 38.

Each infill panel 42 is pre-cast of reinforced concrete but is not intended to be load bearing. However, each panel 41 is of U-shaped cross section with a main body 51 of predetermined thickness, such as 3 or 4 inches, and with a pair of spaced, vertical edge flanges 52 and 53 of increased thickness, for example they may be about 7 inches by 12 inches in section to constitute built-in, integral, supporting columns for carrying the weight of the roof 37 of the building and resisting the compressive forces exerted on the walls thereof. The flanges, or columns, 52 and 53 are full height of the load bearing panels 41 and may project outwardly of the building side wall for buttress decorative effect, but preferably project inwardly so that the space 54 between the legs of the channel shape may be used effectively, as a pipe chase, air duct, recess for a sink unit, or shelf space. The space 54 may also be filled with insulation or covered by wall panels.

Preferably the infill panels 42 are of uniform cross section, although they may be grooved as a decorative feature and are about 4 inches in thickness.

It will be understood that the panels 41 and 42 are pre-cast in a factory and shipped to the site, with the load bearing panels 41 hoisted erect and mounted at spaced distances, equal to the width of an infill panel, around the perimeter of the footing 31.

Figure 3:
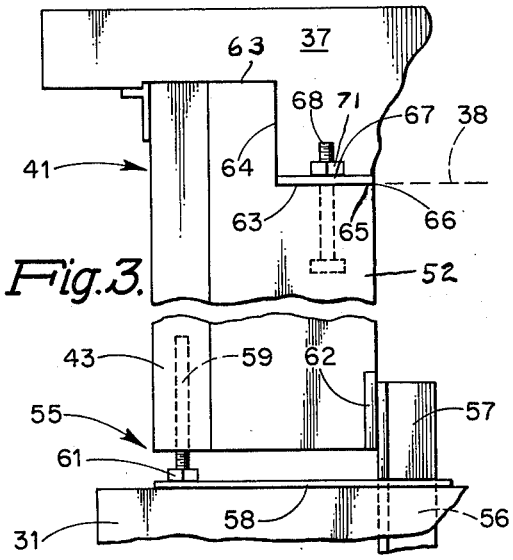
FIG. 3 is an enlarged sectional view showing the roof and footing affixation means.
Figure 4:
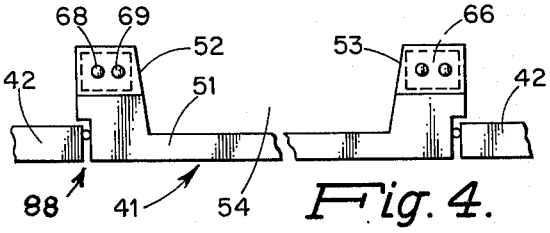
FIG. 4 is an enlarged plan view of the roof framing affixation means.
Figure 5:
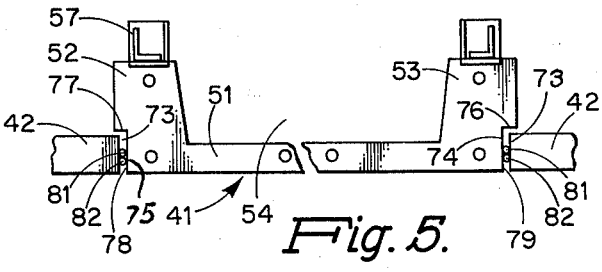
FIG. 5 is a view similar to FIG. 4 of the footing affixation means.
Figure 6:
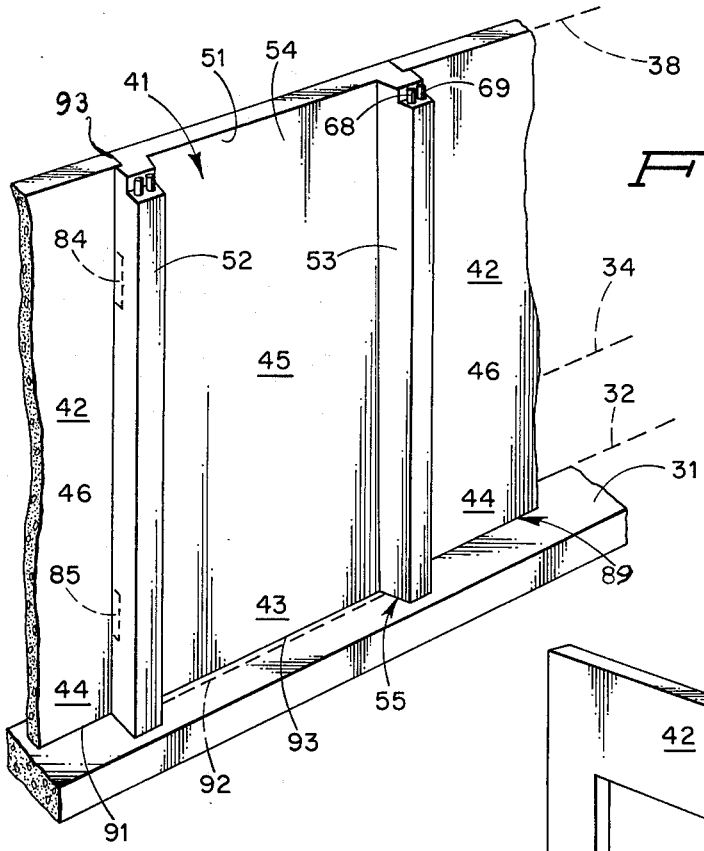
FIG. 6 is a perspective view of a portion of the interior of the building.
Figure 7:
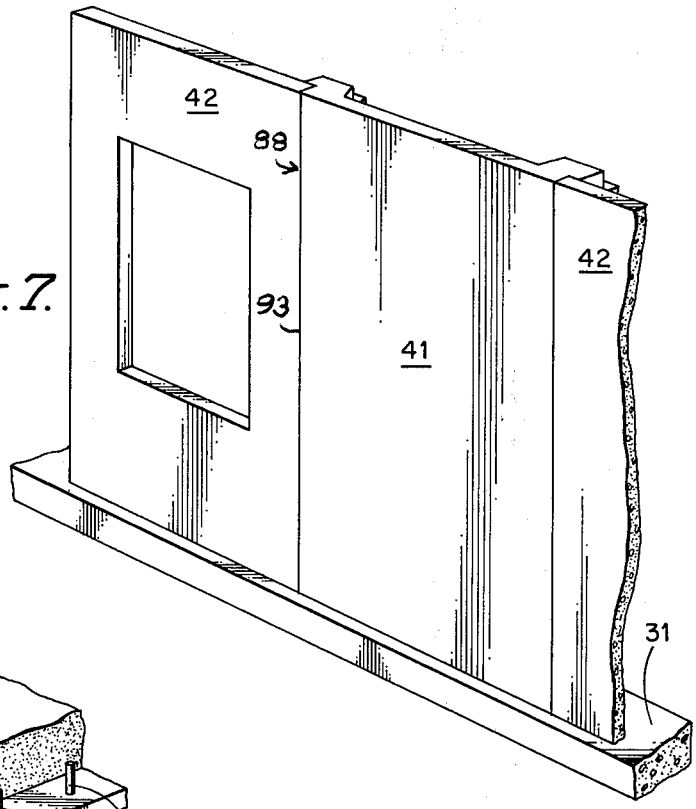
FIG. 7 is a view similar to FIG. 6 of the same panels looking from the exterior.

As best shown in FIGS. 3 to 5, the quick affixation means 55 of the invention includes a steel angle 56 embedded vertically in the footing 31 and having a portion 57 projecting thereabove, a steel plate 58 anchored to the footing and having a bolt 59 upstanding therefrom, a leveling nut 61 on the bolt and a steel plate 62 on the panel 41. When the panel 41 is lowered onto the bolt and against the angle portion 57, the steel plate 62 is welded thereto, the leveling nut turned to level the panel and the nut then welded fast on the bolt. The upper edge 63 of each column 52 or 53 includes a cut-out portion 64 forming a platform 65 for a neoprene pad 66 and seat angle 67, there being a pair of bolts 68 and 69 embedded in the column and projecting upwardly therefrom. The roof trusses, or other members, are suitably formed to fit the shape depicted, including cut-outs 64, and are tightened in place on the bolts by the tightening nuts 71.

Thus the load bearing panels 41 may be leveled, erected and fixed in position around the periphery of the footing by connection to the roof members, which members can also be of pre-cast channel shape similar to panels 41, and each column 52 or 53 will support two juxtaposed roof members, whereby the building is closed in except for the space 73 between the wall panels 41.

Unlike the prior art, in which there has usually been a deep, double side walled groove and corresponding rib connection between the side edges, thereby necessitating the lifting of a panel and attempting to drop it into the grooves, or necessitating an attempt to force an inaccurate rib into an inaccurate groove full height of a panel, no such expedient is attempted in this invention. Instead, each side edge face 74 or 75 of each load bearing panel, or slab, 41 is stepped to form a laterally extending shoulder 76 or 77 which is the inner wall of a groove, or notch, 78 or 79 open at the outside. At least one, and preferably two, rod-like gaskets, or O-rings, 81 and 82 of neoprene or the like are adhered along the mating grooves 78 and 79 of a pair of adjacent panels 41, whereupon an infill panel 42 is hoisted in upright position and moved horizontally into the space 73 to compress the rod-like gaskets 81 and 82 and seal the thus formed vertical joint, or seam. Each panel 41 and 42 is provided with steel plates, such as 84 and 85, about 1 inch by 6 inches in area which become juxtaposed when the infill patent 42 is leveled by suitable leveling bolts and nuts 86 and 87, and which are welded to each other to form the vertical joint connecting and sealing means 88 of the invention.

Upon completion of the leveling, welding and gasketing of the panels, the bottom edges 89 thereof are preferably about 2 inches above the footing and the resulting gap 91 of about 2 inches is filled with "dry pack" 92 consisting of low-moisture content cement and sand mixture and the vertical joints are preferably caulked, as at 93, as an added precaution against air leakage.

Figure 2:
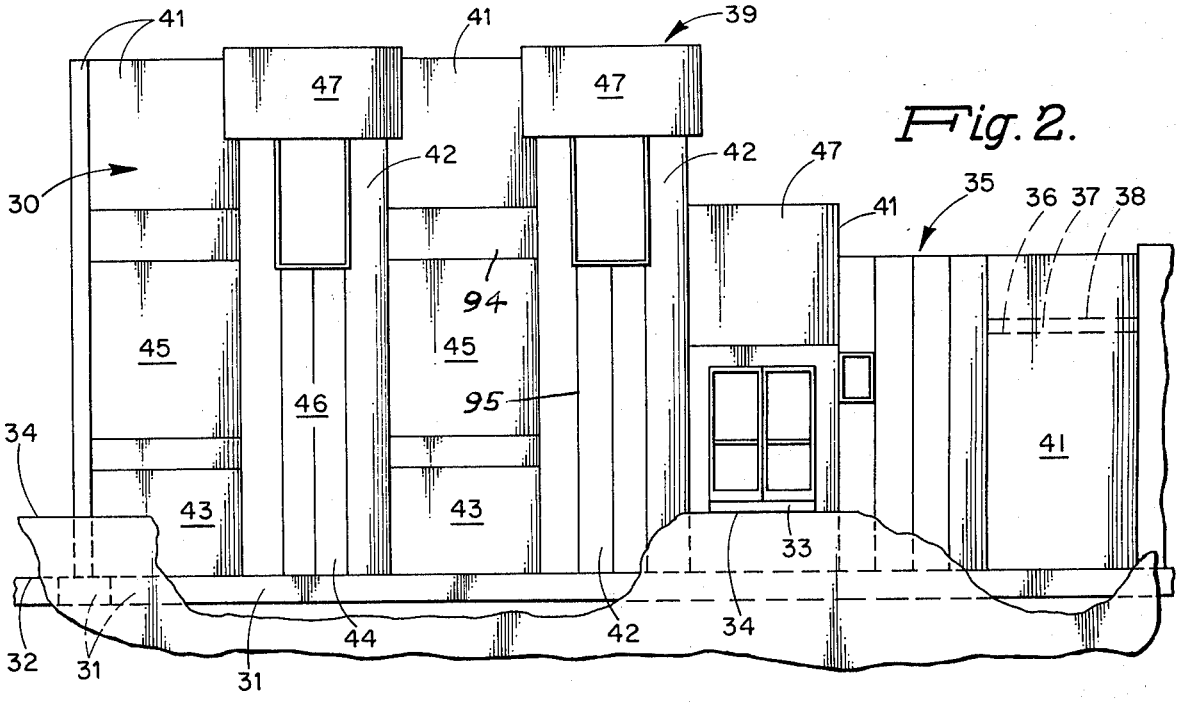
FIG. 2 is a front elevation thereof.

The panels 41 and 42 are pre-cast in suitable forms at the factory with the required reinforcing rods of metal for the columns 52 and 53, the steel plates 84 and 85, integral upstanding bolts 68 and 69, side edge shoulders 76 and 77 and the other components formed, or embedded, in the casting. Decorative or strengthening strips, such as at 94 or 95 (FIG. 2), may be formed and any finish may be obtained as required. The finished panels are then lifted from the forms and stored at the factory or shipped by truck to the job site.

The system of this invention requires a subground level footing, but eliminates the cost and time of pouring foundation walls and permitting them to cure and harden, the cost and time of erecting a load bearing steel or concrete framework, the cost and time of sealing and reinforcing a multiplicity of horizontal and vertical masonry joints, the cost and time of erecting a separate fascia parapet and otherwise saves about two-thirds of conventional construction time.

The infill panels, preferably contain the window and door openings and they may be of aluminum curtain wall construction or any other desired composition. The panels 41 and 42 can be shipped nested because of the taper of the flanges 52 and 53 and can be stacked one above the other to construct high rise buildings. The exterior, or the interior, of the panels may be faced, finished or insulated by direct application of brick, stone, wood veneer, or paint.

I claim:

1. A pre-fabricated wall panel, adapted to be erected with similar panels to form the vertical side wall of a building, said panel comprising:

a pre-cast concrete slab of predetermined height and width extending vertically from an integral subground level, portion, supported on the building footing, to an integral above ground portion for at least one story above ground level, thereby combining in one piece both an upstanding foundation wall and an integral, unitary upstanding, side wall;

said slab being load bearing and having a main body of predetermined thickness and substantial width with a pair of spaced apart, projecting, integral, vertical side edge flanges of increased thickness substantially twice the predetermined thickness of said main body forming integral reinforced concrete vertical columns for resisting compressive stresses with a vertically extending shallow recess therebetween free of intermediate cross flanges;

vertical joint connecting and sealing means along each said vertical side edge flange for structurally affixing and sealing said slab to adjacent panels;

quick attachable affixation means along the horizontal top and bottom edges of said slab for affixing the same to said footing and to the next upper part of said building.

2. A pre-fabricated wall panel as specified in claim 1, wherein:

said vertical side edge flanges, or columns, project inwardly of said slab to permit the shallow space therebetween to serve as a vertically extending pipe chase or air duct, inside said building, and each said slab includes a direct application of another material on the exterior face thereof for facing, finishing, decorating or insulating said slab.

3. A pre-fabricated wall panel as specified in claim 1, wherein:

said vertical side edge flanges each include a vertical groove and shoulder for receiving and seating the adjacent vertical edge of an adjacent infill panel, and the upper edge of each said side edge flange, or vertical column, includes a cut out portion forming a horizontal platform for supporting a roof member.

4. A pre-fabricated wall panel as specified in claim 1, wherein:

said vertical side edge flanges each include a plurality of spaced apart metal plates permanently affixed thereto;

said plates being adapted to be welded to a plurality of corresponding plates of an adjacent panel for affixing said slab and panels together.

5. A pre-fabricated wall panel as specified in claim 1, wherein:

said vertical joint affixing and sealing means includes a groove and shoulder in each said flange for seating the edge of a juxtaposed panel, a vertical, rod-like gasket of neoprene mounted in each said groove and at least two vertically spaced steel plates along each said edge flange for welding said slab and adjacent panels together with said gasket under compression.

6. A pre-fabricated wall panel as specified in claim 1, plus:

an integral portion of said slab adapted to extend above roof level, to form a parapet;

whereby said slab combines, in one piece, a vertical foundation wall, side wall and parapet.

7. A pre-fabricated wall panel as specified in claim 1, wherein:

said quick attachable means along the bottom edge of said slab includes leveling nuts and bolts for leveling said panel on said footing, steel plates affixed at spaced distances vertically along said slab and footing welded to each other and dry pack cement mixture closing any gap between said slab and footing.

8. A pre-fabricated wall panel as specified in claim 1, wherein:

said quick attachable means along the upper edge of said slab includes at least one bolt embedded in each vertical flange to project upwardly therefrom, and tightening nuts threaded on said bolts for affixing the roof, or ceiling, frame members to said slab.

9. A manufactured building of the pre-fabricated type built on a footing with factory made side wall panels shipped to the building site, said building comprising:

a plurality of vertical pre-cast, reinforced concrete sidewall panels, or slabs, of predetermined height, width and thickness, each of U-shaped cross section with integral vertical side edge flanges of about twice the said thickness, forming vertical load bearing columns on each side edge for resisting compressive stresses, separated by a vertically extending shallow recess, and each including an integral vertical sub-ground level portion supported on said footing and an integral vertical side wall portion extending vertically at least one story in height above ground level; and a plurality of vertical infill panels, each of predetermined height, width and thickness, each non-load bearing and certain of said infill panels including the windows and doors of said building;

said U-shaped concrete panels being spaced apart from each other with an infill panel affixed between each adjacent pair thereof and said panels being free of any structural steel framework in the plane of the side wall formed thereby.

10. A building as specified in claim 9, wherein:

each said U-shaped concrete panel includes a groove and shoulder in each opposite side flange, or column, for receiving the edge of one of said infill panels, said concrete panels and infill panels each include a plurality of steel edge plates spaced apart vertically therealong for weld connection thereof and each vertical joint between said welded panels includes at least one flattened, compressed O-ring gasket of neoprene.

11. A building as specified in claim 9 wherein:

at least one face of at least one said panel includes a direct application of another material for facing, finishing, decorating or insulating said building.

12. The method of pre-fabricating a building from manufactured wall panels, shipped to the site of the footing of the building, which comprises the steps of:

pre-fabricating a plurality of load bearing wall panels of U-shaped cross section and a plurality of non-load bearing infill panels, each of the same height to extend from below ground level at said footing vertically to a selected height thereabove, each load bearing panel having a pair of reinforced concrete integral flanges extending normal to the main body thereof;

erecting said load bearing wall panels vertically on said footing, leveling the same and affixing the same at spaced distances apart to said footing around said building; and then affixing each said infill panel to said footing and between the vertical flanges of each pair of adjacent said wall panels, in one of the spaces between said wall panels.

13. A method as specified in claim 12, wherein:

said step of affixing each infill panel in a space between two adjacent load bearing panels includes the steps of seating said infill panel by horizontal movement thereof while upright into groove and shoulder seats in the edges of thee vertical flanges of said load bearing panels while compressing gasket material in the vertical joints so formed therebetween; and then welding said infill panels and load bearing panels to each other by means of plates spaced along said gasketed, shouldered vertical joints to seal the same.

14. A method as specified in claim 12, wherein:

said step of affixing each said infill panel includes the steps of inserting the same while upright, horizontally between the flanges of a pair of adjacent said load bearing panels, levelling said infill panel and then welding the vertical edges of said infill panels to the vertical edges of said load bearing panels by means of metal plates spaced along said flanges.

* * * * *